US007168634B2

(12) United States Patent
Onofrio

(10) Patent No.: US 7,168,634 B2
(45) Date of Patent: Jan. 30, 2007

(54) DEBRIS RESISTANT COLLAR FOR ROTATING STREAM SPRINKLERS

(75) Inventor: Travis L. Onofrio, Whittier, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 10/971,858

(22) Filed: Oct. 22, 2004

(65) Prior Publication Data

US 2005/0082387 A1 Apr. 21, 2005

Related U.S. Application Data

(63) Continuation-in-part of application No. 10/310,584, filed on Dec. 4, 2002, now Pat. No. 6,814,304.

(51) Int. Cl.
*B05B 3/04* (2006.01)

(52) U.S. Cl. ..... 239/222.17; 239/104; 239/106; 239/201; 239/203; 239/222.11; 239/223; 239/231; 239/232; 239/252; 239/382; 239/460; 239/522

(58) Field of Classification Search ..... 239/200, 239/201, 252, 214, 223, 222.11, 222.17, 224, 239/231, 225.1, 232, 251, 288, 382, 288.3, 239/288.5, 383, 451, 456, 457, 460, 203, 239/522, 104, 106
See application file for complete search history.

(56) References Cited

U.S. PATENT DOCUMENTS 2,108,787 A 2/1938 Coles et al.
3,580,507 A 5/1971 Beamer
3,592,388 A 7/1971 Friedlander
3,888,417 A 6/1975 Harmon
4,265,403 A 5/1981 Bonetti
4,440,345 A 4/1984 Figwer et al.
4,637,549 A 1/1987 Schwartzman
4,660,766 A 4/1987 Nelson et al.
4,681,259 A * 7/1987 Troup et al. ..... 239/206
4,687,139 A 8/1987 Lockwood
4,796,811 A 1/1989 Davisson
4,815,662 A * 3/1989 Hunter ..... 239/222.17
4,886,211 A 12/1989 Cohen
4,898,332 A 2/1990 Hunter et al.
4,932,590 A 6/1990 Hunter
4,971,250 A * 11/1990 Hunter ..... 239/222.17
4,986,474 A * 1/1991 Schisler et al. ..... 239/205
5,007,586 A 4/1991 Cohen (Continued)

*Primary Examiner*—Steven J. Ganey
(74) *Attorney, Agent, or Firm*—Fitch, Even, Tabin & Flannery

(57) ABSTRACT

A sprinkler head having a deformable member forming a collar is disclosed. The deformable member allows the sprinkler head to resist entry of foreign grit or matter within the sprinkler head, and allows the sprinkler head to eject or force out foreign matter from within the sprinkler head. The sprinkler head may be a spinning sprinkler head including a vane deflector, and the spinning sprinkler head may include a portion that shifts in response to being struck by water such that a braking mechanism is engaged in response to the force of the water. When water flow ceases, the spinning head may shift towards the deformable member so that a portion of the spinning head is received within the deformable member to restrict foreign matter from entering the sprinkler head.

28 Claims, 8 Drawing Sheets

U.S. PATENT DOCUMENTS 5,014,372 A 5/1991 Thrasher et al.
5,058,806 A 10/1991 Rupar
RE33,823 E 2/1992 Nelson et al.
5,224,653 A 7/1993 Nelson et al.
5,288,022 A 2/1994 Sesser
5,297,737 A 3/1994 Davisson
5,353,989 A 10/1994 Drechsel
5,372,307 A 12/1994 Sesser
5,377,914 A 1/1995 Christen
5,423,486 A * 6/1995 Hunter ..... 239/205
5,476,223 A 12/1995 Drechsel
5,671,886 A 9/1997 Sesser
5,711,486 A * 1/1998 Clark et al. ..... 239/205
5,730,365 A 3/1998 Messinger
5,845,849 A 12/1998 Mitzlaff
5,971,297 A 10/1999 Sesser
5,988,523 A * 11/1999 Scott ..... 239/114
6,135,364 A 10/2000 Nickish
6,193,169 B1 2/2001 Steinhilber et al.
6,244,521 B1 6/2001 Sesser
6,499,672 B1 12/2002 Sesser
6,651,905 B2 * 11/2003 Sesser et al. ..... 239/205

* cited by examiner

DEBRIS RESISTANT COLLAR FOR ROTATING STREAM SPRINKLERS

CROSS-REFERENCE TO RELATED APPLICATION

This application is a Continuation-in-Part and claims benefit of U.S. application Ser. No. 10/310,584, filed Dec. 4, 2002, now issued as U.S. Pat. No. 6,814,304, the specification of which is incorporated herein by reference in its entirety.

FIELD OF THE INVENTION

The invention relates to a rotating stream sprinkler and, in particular, to a rotating stream sprinkler with improved resistance to malfunctions due to foreign particulate matter.

BACKGROUND OF THE INVENTION

Currently, many sprinklers are mounted or otherwise used in close proximity to ground or plants. More broadly speaking, it is most common for sprinklers to be utilized in environments were it is difficult to control all the elements that may come into contact with the sprinkler head. For instance, a sprinkler located in a greenhouse and turned off so that it is not emitting water may, nonetheless, be positioned in close proximity to a plant that is being re-potted such that loose dirt may be accidentally scattered and reach the sprinkler. In a field or yard, animals or people moving in close proximity to a sprinkler head may inadvertantly dislodge dirt or particulate matter into a sprinkler positioned at or just above ground level. Golfers typically cannot predict where a ball is going to end up, let alone the divots and sand that often are dislodged by each swing. In simple terms, many types of debris may come in contact with a sprinkler head, including rocks, mulch, sticks, and grass, each of which may impair or impeded the ability of the sprinkler to operate properly.

Such dirt or particulate matter may impair or cause a malfunction in many types of sprinklers. One such type of sprinkler is a rotating stream, or spinner-type, sprinkler. A spinner sprinkler typically forces a stream or streams of water against a deflector such that the force of the water causes the deflector to rotate around its central axis. The deflector includes radially positioned vanes through which the water passes, and the vanes distribute the water outwardly from the deflector as the deflector spins. Water passes through the sprinkler head in a generally upward manner, and then strikes the deflector so that the water is emitted. The momentum of the water striking arcuate radial vanes of the deflector causes the sprinkler head to rotate so that the water is dispersed in a radial manner from the deflector. In the event particulate matter or debris becomes lodged against the vaned deflector, such matter may impede or stop the spinning of the deflector. In this event, the water emission is unpredictable and, typically, undesirable.

Accordingly, there has been a need for an improved sprinkler head that has an improved resistance to entry of foreign debris or particulate matter.

DESCRIPTION OF THE PREFERRED EMBODIMENTS

Figure 1:
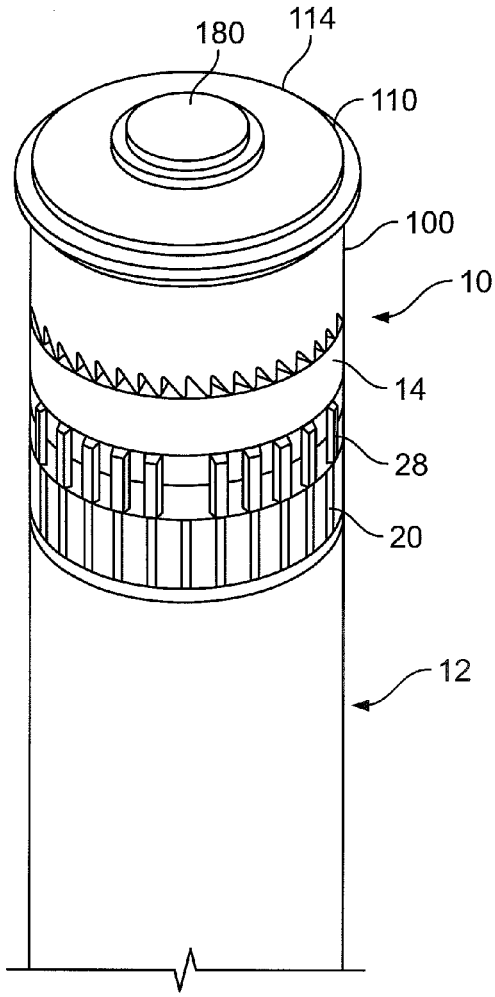
FIG. 1 is a perspective view of a sprinkler head in accordance with the present invention secured to a riser showing the sprinkler head in a position corresponding to a water flow to the sprinkler head being shut off.
Figure 2:
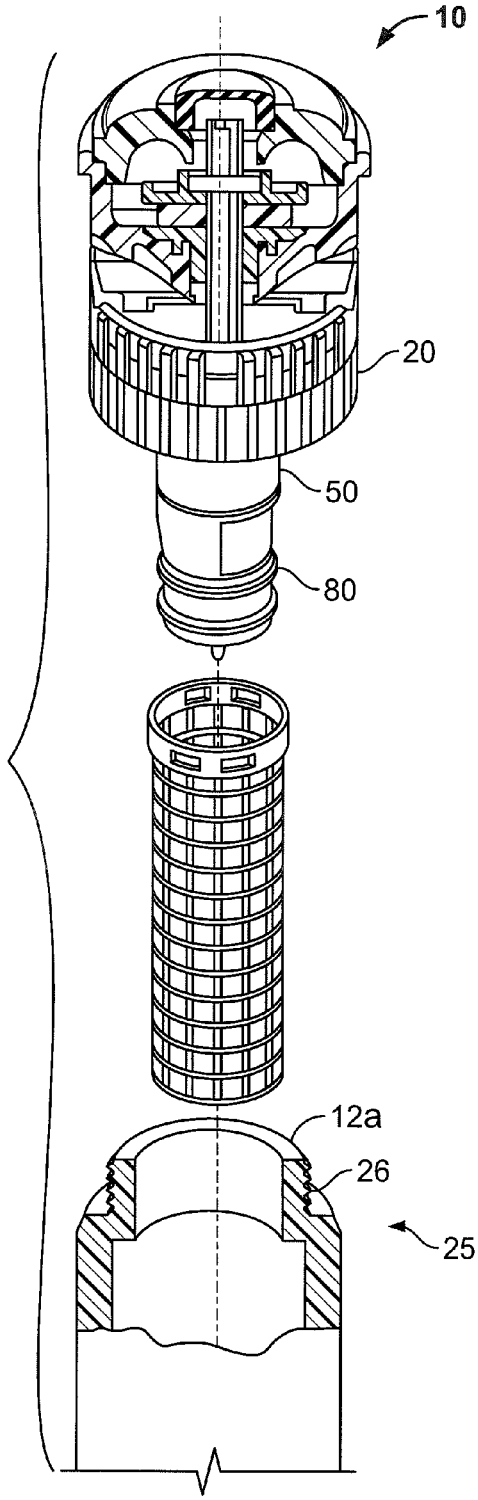
FIG. 2 is a partially exploded and partial cross-section view of the sprinkler head of FIG. 1.

Referring initially to FIGS. 1–4, a sprinkler head 10 in accordance with the present invention is depicted attached to a riser 12 and having a grit member 14 for retarding the entry of debris, grit, or any other foreign matter into the sprinkler head 10. In operation, the riser 12 is connected to a water source (not shown) for delivering water to the sprinkler head 10 for emission to an area surrounding the sprinkler head 10. The riser 12 is typically a cylindrical pipe, as shown, such that it cooperates with a second, stationary pipe (not shown). In this manner, the riser 12 may rise or lower depending on the flow of water. That is, when the sprinkler head 10 is activated by turning on a flow of water to the sprinkler head 10, the riser 12 connected to the sprinkler head 10 and the stationary pipe rises to an extended position. When the water flow is shut off, the riser 12 recedes or retracts to a lower position relative to the stationary pipe. Such a sprinkler system is commonly known as a pop-up sprinkler system, and the sprinkler head 10 is known as a pop-up sprinkler head.

The pop-up sprinkler head 10, consequently, reciprocates relative to a ground level, depending on whether the water flow is activated or shut off. In any event, the sprinkler head 10 is typically located in close proximity to the ground level during operation when the water flow is activated. Furthermore, when the sprinkler head 10 retracts along with the riser 12 as water is shut off, the sprinkler head 10 comes to rest adjacent or coincident with the ground level. At each position, the sprinkler head 10 is likely to come into contact with dirt, debris, insects and bugs, and surrounding plants.

The sprinkler head 10 includes a base 20 secured to the riser 12 such that the sprinkler head 10 generally reciprocates with the riser 12 as the water flow is activated or shut off. The base 20 is generally cylindrical and includes an interior surface 22 having internal threads 24, and the riser includes a cylindrical terminal portion 25 including external threads 26 for mating with the base threads 24. In this manner, the sprinkler head 10 is easily attached or detached to the riser 12 by rotationally securing the mating threads 24, 26.

The sprinkler head 10 further has an emission member in the form of a pattern plate 28 fixedly secured to the base 20. The pattern plate 28 includes an annular or cylindrical outer wall 30, a hub portion 32, and a plate portion 31, each of which will be discussed herein. The outer wall 30 is fixedly secured to a step 20*a* of the base 20 so that the base interior surface 22 and the plate portion 31 form a shoulder 40 therebetween. A gasket or O-ring 42 is located along the shoulder 40 such that, when the base 20 is threaded onto the riser 12, a top riser edge 12*a* contacts the gasket 42. In this manner, the gasket 42 is compressed between the riser edge 12*a*, the base interior surface 22, and the plate portion 31 to generally seal each with the other.

Figure 5:
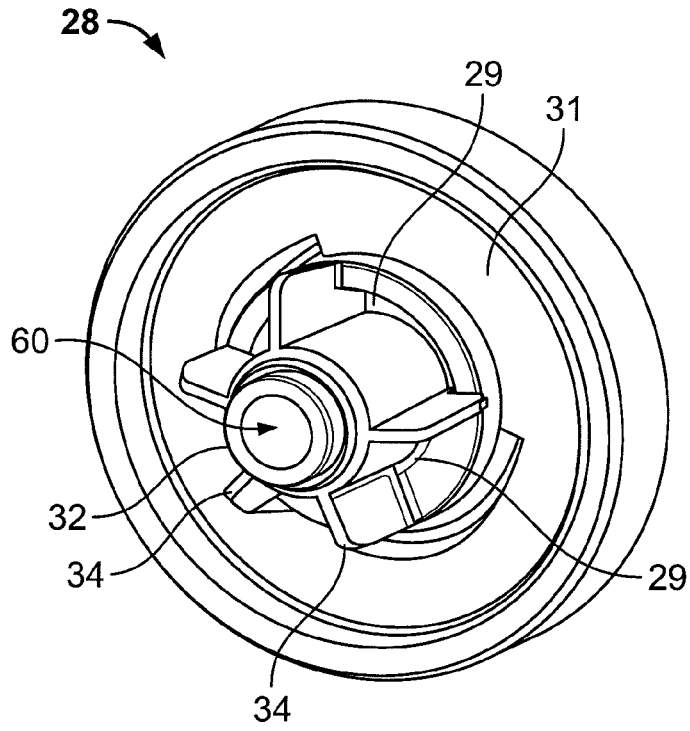
FIG. 5 is a perspective view of an emission member of the sprinkler head.

A plurality of radial walls 34 are located on the bottom side of the pattern plate 28 and extend from the hub portion 32, as can be seen in FIG. 5. A stationary valve member 50 is at least partially received by the base cylindrical wall 20 and by the pattern plate outer wall 30. The stationary valve member 50 includes a generally cylindrical wall 52 that generally surrounds the radial walls 34. The stationary valve member cylindrical wall 52 has a top portion 52*a* received by the pattern plate 28 and between the pattern plate hub portion 32 and the gasket 42, thereby providing a seal therebetween. The stationary valve member cylindrical wall 52 includes an inner surface 56 with at least one structure such as a recess 58 (see FIG. 4) into which one of the radial walls 34 is received. In this manner, the stationary valve member 50 is prevented from moving rotationally relative to the base 20, pattern plate 28, and, therefore, the riser 12.

The pattern plate hub portion 32 and stationary valve member 50 include respective central bores 60, 62 that are aligned for receiving a shaft member in the form of an axle 70. Additionally, a movable valve member 80 is located below the stationary valve member 50 and includes a central bore 64 aligned with the pattern plate hub portion and stationary valve member central bores 60,62. Accordingly, the movable valve member central bore 64 receives the axle 70 therethrough. The movable valve member 80 and stationary valve member 50 cooperate to form a valve regulating the flow of water through the sprinkler head 10.

Figure 7:
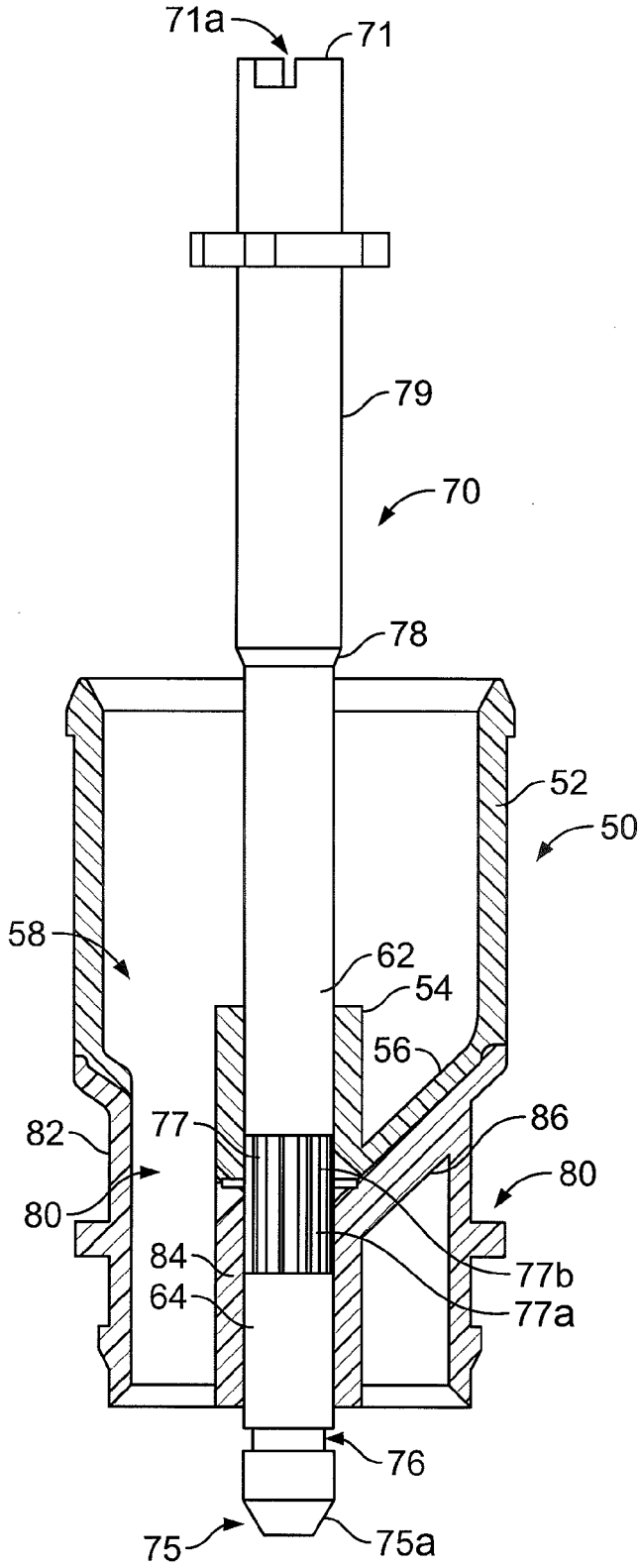
FIG. 7 is a partial cross-sectional view of a valve and shaft member of the sprinkler head.
Figure 8:
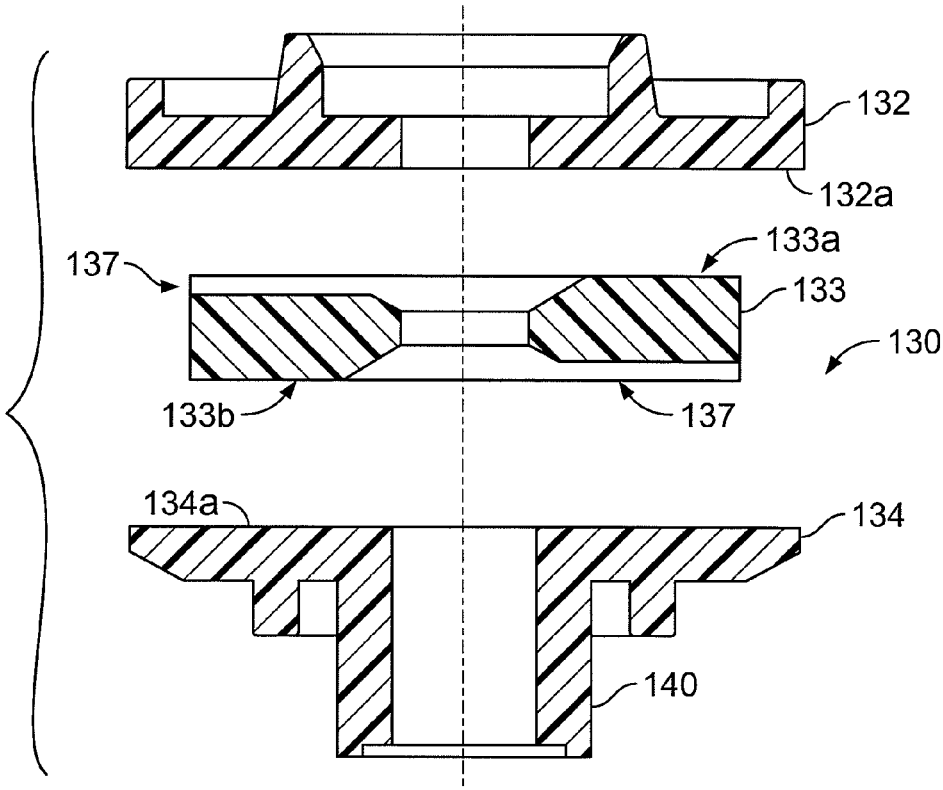
FIG. 8 is an exploded cross-sectional view of a braking mechanism of the sprinkler head.
Figure 9:
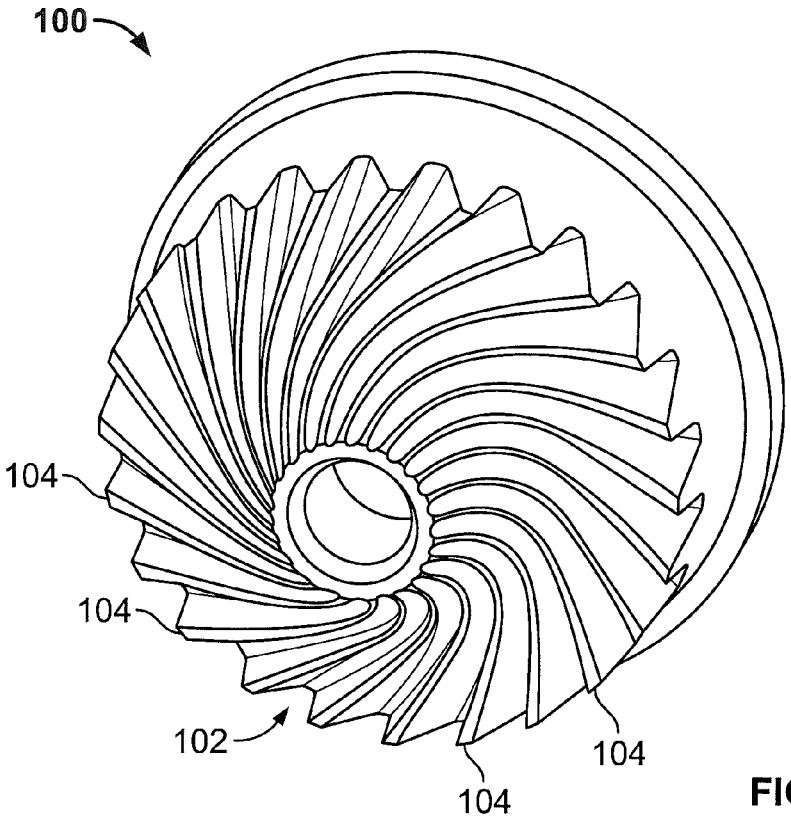
FIG. 9 is a perspective view of a deflector of the sprinkler head.

As described above and illustrated in FIG. 7, the stationary valve member 50 includes an outer cylindrical wall 52. In addition, the movable valve member 80 includes an outer cylindrical wall 82. Each of the valve member cylindrical walls 52, 82 are joined to respective hubs 54, 84, which include the respective central bores 62, 64, by respective partial conical valve walls 56, 86. More specifically, the valve walls 56, 86 extend from a portion of each hub 54, 84 to a portion of each cylindrical wall 52, 82. Each valve member 50, 80 further includes respective valve openings 58, 88 to permit fluid flow through each valve member 50, 80. The relative position of the valve members 50, 80 may be adjusted by rotating the axle 70. In this manner, the movable valve opening 88 may be aligned with the stationary valve opening 58 to permit maximum water flow therethrough, may be aligned with the stationary valve conical wall 56 to generally prevent water flow therethrough, or may be partially aligned with both the stationary valve opening 58 and valve conical wall 56 to selectively determine the amount of water flow therethrough.

Below the movable valve member 80 is a washer 72 and a retainer in the form of a snap ring 74. A lower portion 75 of the axle 70 is frusto-conical to form chamfer or cam surfaces 75*a* to aid insertion of the axle 70 within components of the sprinkler head 10. An annular recess 76 is located on the axle 70 above the lower portion 75 into which the snap ring 74 is attached for retaining components of the sprinkler head 10 on the axle 70.

A short distance above the annular recess 76 is a knurled portion 77. A lower part 77*a* of the knurled portion 77 is received within the movable valve member bore 64, and an upper part 77*b* is received within the stationary valve member bore 62. In this manner, the knurled portion 77 cooperates with the bores 62, 64 such that relative motion there between is frictionally restricted, and such motion requires overcoming the friction. Consequently, the valve members 50, 80 may be rotationally shifted relative to each other by rotating the axle 70. More specifically, the stationary valve member 50 is prevented from rotation relative to the riser 12 and base 20 due to its recess 58 receiving a radial wall 34 of the pattern plate hub portion 32, and the pattern plate 28 is secured to the base 20. When the axle 70 is rotated, the stationary valve member 50 is prevented from moving with the axle 70. However, the movable valve member 80 rotates along with the axle 70. In this manner, the valve formed by the valve members 50, 80 is adjusted by rotating the axle 70 and the movable valve member 80.

The axle 70 includes a shoulder 78 such that the axle 70 has an upper portion 79 of greater diameter. In assembly, the attached pattern plate 28 and base 20 receive the axle 70 such that the pattern plate hub portion 32 contacts the shoulder 78. A washer 86 is inserted around the axle 70 abutting a bottom edge 32*a* of the hub portion 32 to retain the pattern plate 28 in position. The stationary valve member 50 is assembled with the hub portion 32, as described, and the movable valve member 80 is then assembled to abut the stationary valve member 50. As both valve members 50, 80 are positioned with their internal bores 62, 64 contacting the axle knurled portion 77, the valve members 50, 80 are generally restricted or prevented from axially shifting along the axle 70 once assembled thereon. The washer 72 is then inserted around the axle 70 to abut a lower edge 80*a* of the movable valve member 80, and the snap ring 74 is then secured to the annular recess 76.

The movable valve member cylindrical wall 82 further secures with a filter or screen 90. As can be seen from the Figures, the valve members 50, 80, and the screen 90 generally depend below the base 20 such that these are received within the riser 12 and are in direct contact with flow the from water source. Accordingly, water flowing through the sprinkler head 10 passes from the riser 12 and water source through the screen 90, and the screen 90 serves to restrict entry of particulate matter from the water source from entering the sprinkler head 10. The water then passes through the valve members 50, 80 and then through the pattern plate 28.

Figure 6:
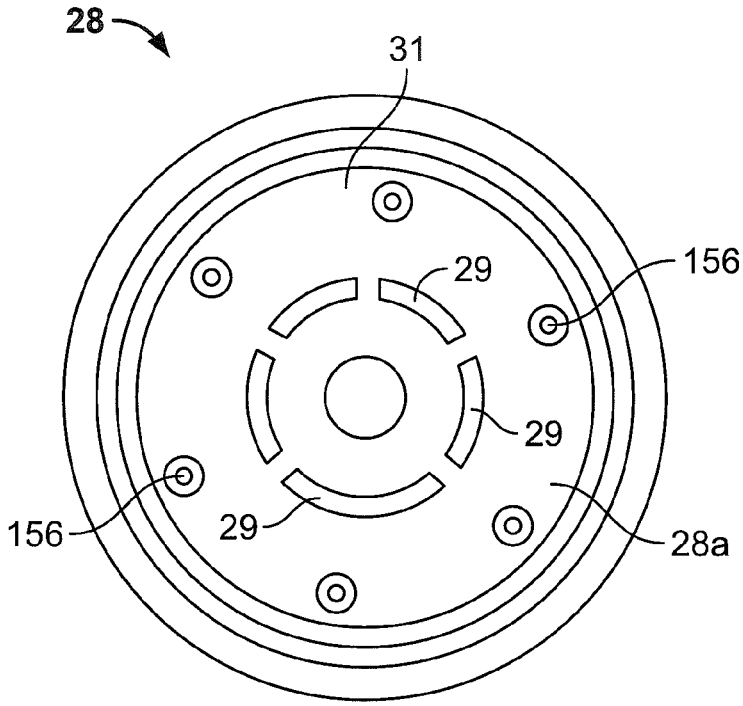
FIG. 6 is a top plan view of the emission member.

As can best be seen in FIG. 6, the pattern plate 28 includes openings 29 radially positioned around the hub portion 32 and extending through the plate portion 31. The openings 29 form a nozzle or nozzles from which water is emitted. The openings 29 may be provided such that a full circumference of water passes through the openings 29, or may be provided such that only an arc of water passes therethrough.

A deflector 100 and a cap 110 secured thereto each include central bores 101, 111 for receiving the axle upper portion 79. The deflector 100 cooperates with the nozzle openings 29 to emit water from the sprinkler head 10. The deflector 100 includes a bottom surface 102 angled upward and outwardly in an outboard direction. The bottom surface 102 includes a series of vanes 104 that are arcuately or spirally configured such that water impacting the vanes 104 causes a rotational force upon the deflector 100. Water flowing through the sprinkler head 10 exits the pattern plate 28 through the openings 29, and then strikes the deflector 100 in a generally upward direction. The water flow causes the deflector 100 and cap 110 to rotate around the axle such that water is emitted from the deflector in a radially spinning manner.

The deflector 100 and the cap 110 form a generally closed head portion 120, and each includes respective seals 105, 115 for generally preventing entry of water or foreign matter to enter the head portion 120 and respective bushings or bearing surfaces 103, 113 for contacting in a low-friction manner the axle upper portion 79. Within the head portion 120 and between the bearing surfaces 103, 113, a brake mechanism 130 is located. Each bearing surface 103,113 allows the head portion 120 to reciprocate along the axle upper portion 79.

The brake mechanism 130 includes an upper brake disk 132 and a lower brake disk 134 separated by a brake pad 133. The brake pad 133 is centered around the axle upper portion 79. The upper brake disk 132 is secured to the axle upper portion 79 such the upper brake disk 132 is generally stationary and does not rotate or axially translate relative to the axle 70. The lower brake disk 134 includes a pad hub 140, which is in turn secured to an interior surface 106 of the deflector 100. Therefore, any motion of the deflector 100 and cap 110 is followed by the pad support 140 and lower brake disk 134. That is, as the deflector 100 rotates or shifts axially along the axle 70, the lower brake disk 134 also rotates and reciprocates.

The upper brake disk 132 has a friction surface 132*a*, and the lower brake disk 134 has a friction surface 134*a*, while the brake pad 133 positioned between the friction surfaces 132*a*, 134*a* includes top and bottom friction surfaces 133*a* and 133*b*. The friction surfaces 132*a*, 134*a* are located on respective bottom and top surfaces 132*b* and 134*b* of the brake disks 132, 134 such that the friction surfaces 132*a*, 134*a* are confronting and contact respective brake pad surfaces 133*a*, 133*b* when the brake mechanism 130 is engaged due to force of water on the deflector 100. Each friction surface 132*a*, 134*a*, 133*a*, 133*b* may be coated with a thin film of a selected lubricant, such as a suitable synthetic based lubricant or grease fortified with PTFE (polytetrafluoroethylene) or the like such that the static coefficient of friction is reduced between the surfaces 132*a*, 134*a*, 133*a*, 133*b*. In such an arrangement, the breakout friction or torque between surfaces 132*a*, 134*a*, 133*a*, 133*b* is less than the running friction or torque to provide effective start-up operation even at relatively low hydraulic pressures. In this regard, by providing minimal friction braking at low pressure start-up operation, the deflector may be initially rotated while overcoming the friction between the surfaces 132*a*, 134*a*, 133*a*, 133*b* and between the axle 70 and the seals 105, 115. In the event water enters the head portion 120, the lubricant tends to repel water from the surfaces 132*a*, 134*a*, 133*a*, 133*b* so that proper, predictable operation is insured.

Figure 15:
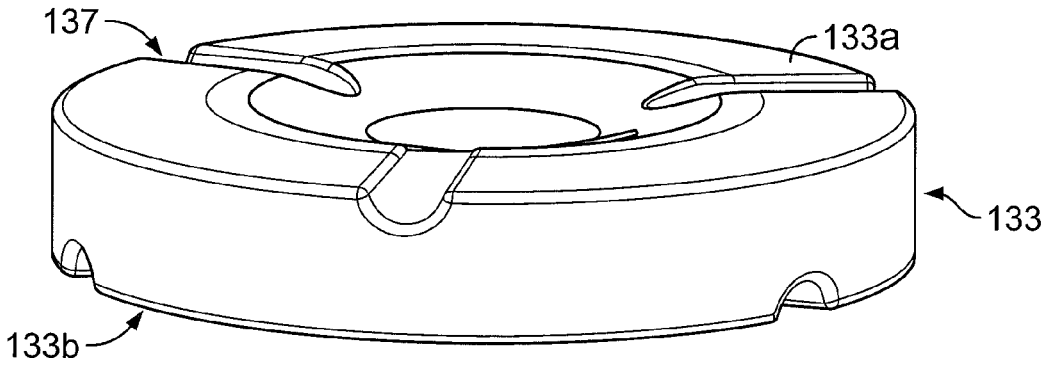
FIG. 15 is a perspective view of a brake member of the braking mechanism of FIG. 8.

Beneficially, the friction surfaces 132*a*, 134*a*, 133*a*, 133*b* may include grooves 137 for allowing the lubricant to escape from between the surfaces 132*a*, 134*a*, 133*a*, 133*b* so that they do not run on the lubricant. In the preferred embodiment, the pads surfaces 133*a*, 133*b* have three radial grooves 137 positioned every 120 degrees, and the grooves 137 on the top surface 133*a* are staggered 60 degrees with respect to the grooves 137 on the bottom surface 133*b*, as is best seen in FIG. 15.

As mentioned above, water exits the pattern plate 28 in a generally upward direction and strikes the deflector 100. The deflector 100, in response, is rotated by the water which passes through the vanes 104 and is emitted thereabout. In addition, the upward momentum or force of the water causes the deflector 100 to shift upward. When the water flow pressure is relatively low, the upward force is also relatively low. Conversely, a greater water flow pressure has a greater upward force against the deflector 100.

As the deflector 100 is shifted upward relative to the axle 70 due to the water force, the lower brake disk 134 moves into contact with the brake pad 133, which in turn moves into contact with the upper brake disk 132, which is stationary relative to the axle 70. More specifically, the upper brake disk 132 is secured to the axle 70 and generally prevented from shifting axially or rotationally relative to the axle 70. The upward force of the water on the deflector 100 when the water flow is activated causes the deflector 100 and lower brake disk 134 to rotate, and forces the lower brake disk 134 against the brake pad 133. The brake pad 133 is, in turn, forced into contact against the upper brake disk 132. This contact creates rotational friction between the brake disks 132, 134 and the brake pad 133, and a greater upward force on the deflector 100 results in a greater axial force and, therefore, greater rotational friction force between the brake disks 132, 134 and the brake pad 133.

Accordingly, the brake mechanism 130 retards rotation of the head portion 120 during operation. In the absence of the brake mechanism 130, a high or excessive water flow may cause the head portion 120 to over-spin, or spin too rapidly, such that water is not properly distributed from the sprinkler head 10. The brake mechanism 130 retards this spinning such that the braking force between the brake disks 132, 134 and brake pad 133 increases when the water flow increases. Accordingly, the preferred operation of the brake mechanism utilizes the shifting head portion 120 and deflector 100 so that the braking force can be varied by force against the deflector 100.

In use, it is not uncommon for particulate or foreign matter to come in contact with the sprinkler head 10, as discussed above. Specifically, matter may enter the sprinkler head 10 between the deflector 100 and the nearest structure therebelow such as, for instance, the rigid pattern plate 28 or base. More specifically, this matter may become lodged between one or more vanes 104 on the deflector 100 and the pattern plate cylindrical outer wall 30, or another nearby surface, such as the plate portion 31 and openings 29, or hub portion 32. In this case, the deflector 100 may not rotate properly, if at all. In fact, the greater the distance the deflector vanes 104 are separated from other structure, the greater the size of foreign matter that may enter and become lodged between the vanes 104 and other, nearby structure. Therefore, when the head portion 120 shifts upward in response to being struck by water, discussed above, thereby activating the brake mechanism 130, the distance between the deflector vanes 104 and the pattern plate 28 increases.

Figure 3:
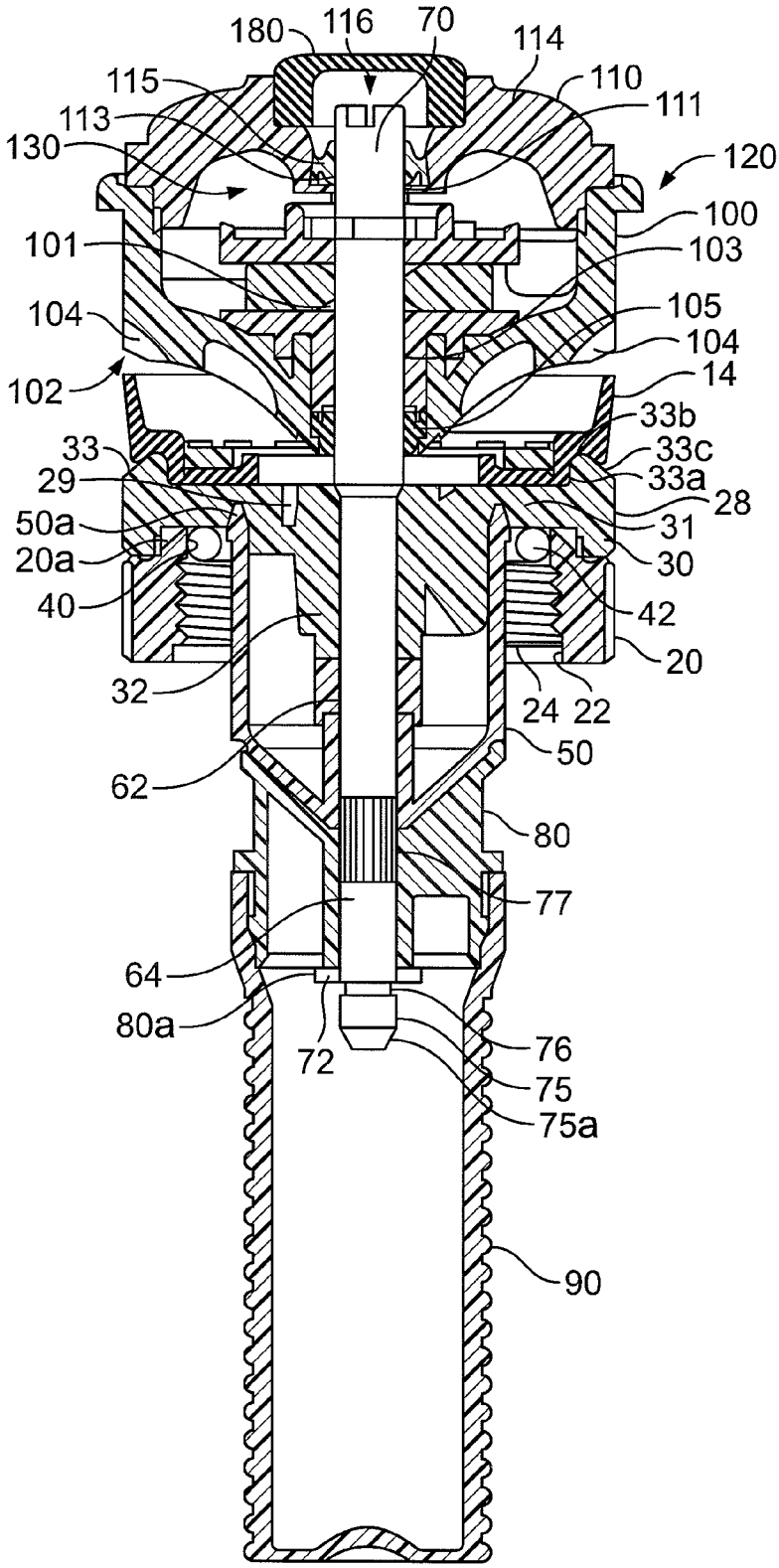
FIG. 3 is a cross-sectional view of the sprinkler head.
Figure 4:
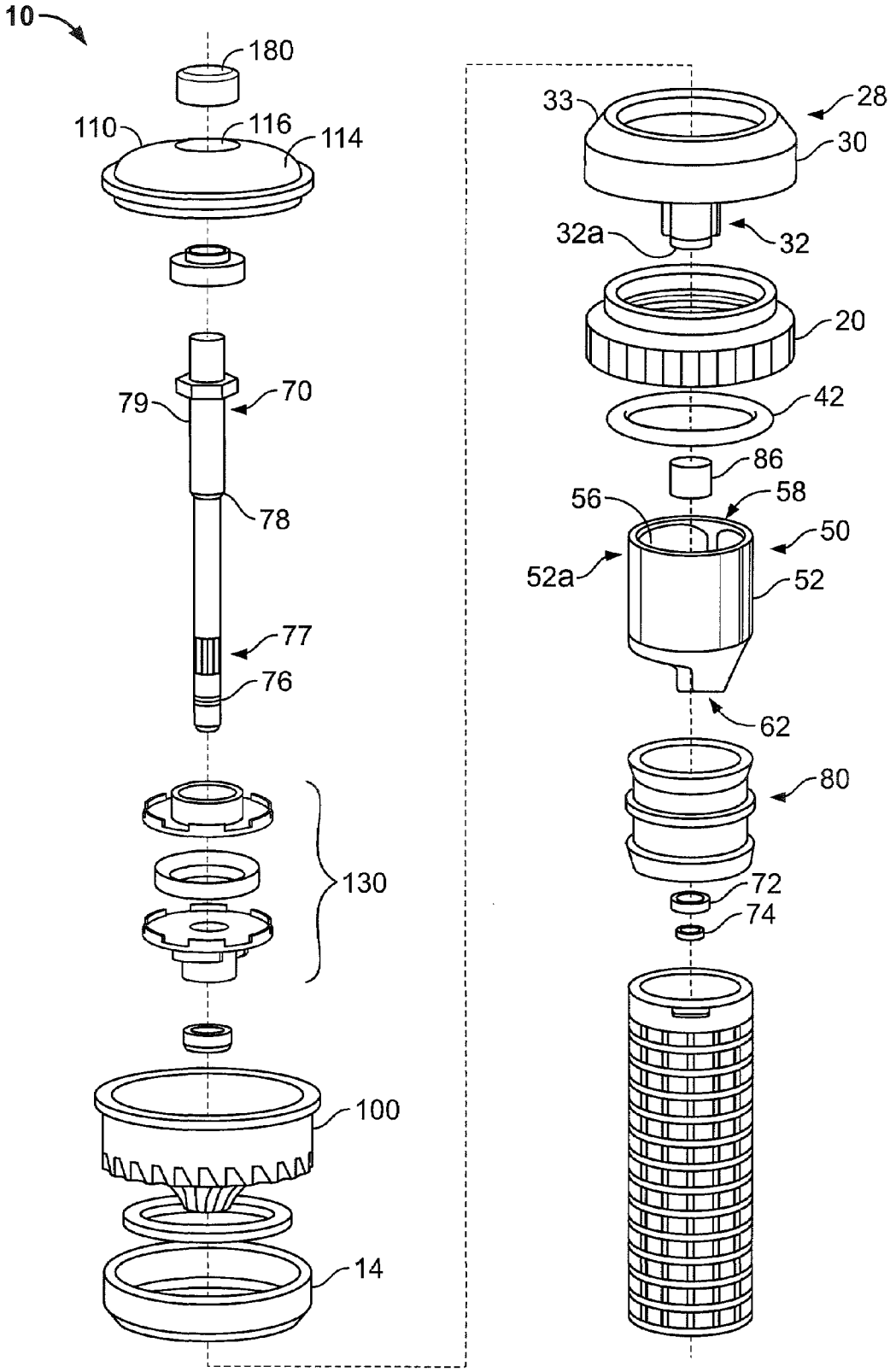
FIG. 4 is an exploded view of the sprinkler head.
Figure 10:
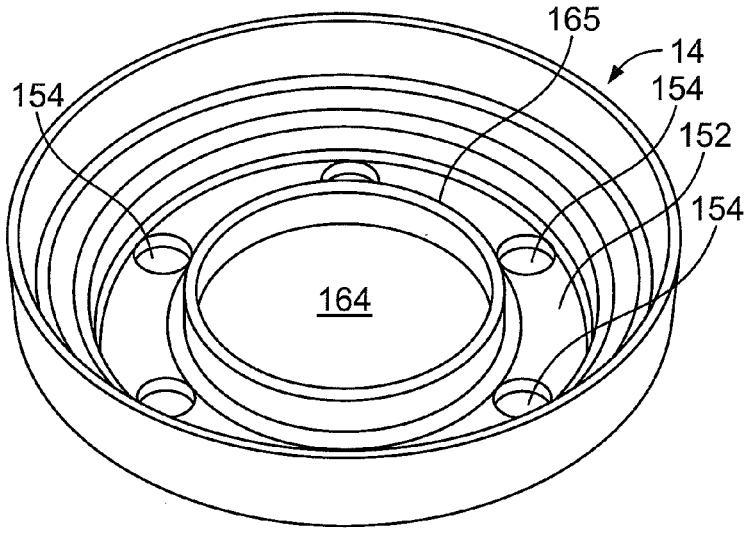
FIG. 10 is a perspective view of a deformable member of the sprinkler head.
Figure 11:
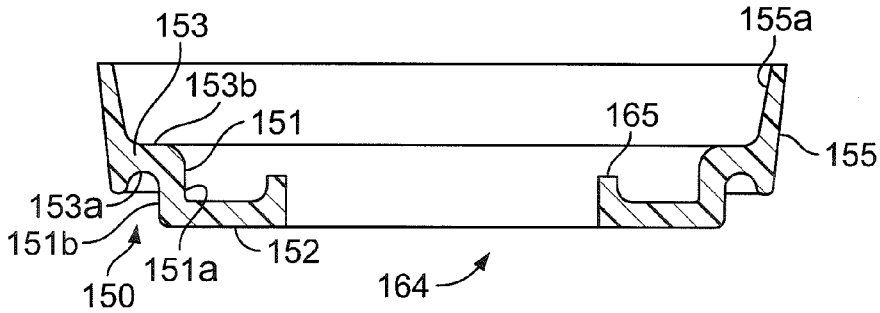
FIG. 11 is a cross-sectional view of the deformable member.

To retard the entrance of foreign matter, the grit member 14 is positioned between the pattern plate cylindrical wall 32 and the vaned bottom surface 102 of the deflector 100, as can be seen in FIG. 3. Referring now to FIGS. 10 and 11, the grit member 14 is a relatively soft, resiliently deformable member including a central opening 164 surrounded by an annular inner wall 165 sized to be outboard and clear of the pattern plate openings 29. Water passing through the pattern plate openings 29 is free to do so without impedance from the grit member 14, and the inner wall 165 surrounding the openings 29 assists in directing the water flow upward towards the deflector 100.

The grit member 14 further includes a central hub portion 152 extending radially outward from the inner wall 165. The grit member 14 is preferably secured to the sprinkler head 10 such that the soft material of the grit member 14 is not deformed or degraded by the securing process. To this end, the grit member hub portion 152 is secured to a top surface 28*a* pattern plate 28 (see FIG. 6).

Figure 12:
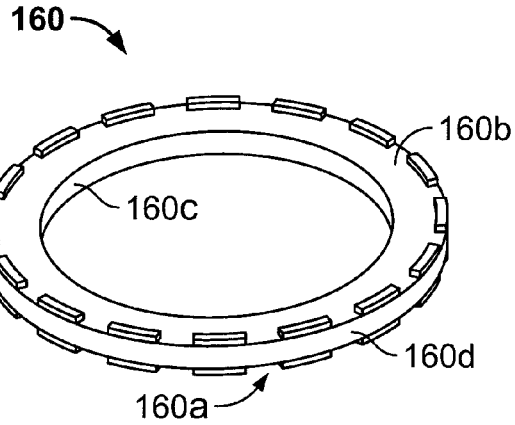
FIG. 12 is a perspective view of a securement member of the sprinkler head.

The grit member hub portion 152 includes pin bores 154 positioned and sized to correspond with upward standing pins 156 on the pattern plate top surface 28*a*. The grit member 14 is located on the top surface 28*a* so that the pins 156 are received by and pass through the pin bores 154. An annular securement disc 160 (FIG. 12), having bottom and top surfaces 160*a* and 160*b*, is set with its bottom surface 160*a* on the pins 156 projecting through the pin bores 154. The bottom surface 160*a* is secured to the pins 156 by, for example, ultrasonic welding. In this manner, the grit member 14 is securedly held between the securement disc 160 and the pattern plate top surface 28*a*. Moreover, the grit member 14 is secured without utilizing glue or other materials, without heat, or another means that may interact with, warp, or degrade the soft, polymeric material of the grit member 100. To provide additional retention of the grit member 14 with the pattern plate 28, the securement disc 160 is provided with cleats or feet in the form of short walls 161. When the securement disc 160 is attached to the pattern plate 28, the walls 161 bite into the soft, deformable material of the grit member 14.

Other than the upstanding walls 161, the securement disc top surface 160*b* is preferably relatively smooth and providing low friction such that an particulate matter that may come into contact with the surface 160*b* is unlikely to find purchase for becoming lodged therewith, such as between the vanes 104 and the top surface 160*b*. The securement disc 160 also includes inner and outer surfaces 160*c* and 160*d*, and the inner surface 160*b* contacts the inner wall 165 to retard lodging of matter therebetween.

The grit member 14 further includes a stepped annular collar 150 located around and extending radially outward and axially upward from the grit member hub portion 152. Specifically, the annular collar 150 includes a upward extending seal portion 151 having inner and outer surfaces 151*a*, 151*b*. The inner surface 151*a* contacts the outer surface 160*d* of the securement disc 160 to retard lodging of matter therbetween. The seal portion outer surface 151*b* contacts the pattern plate cylindrical wall 30.

The pattern plate cylindrical wall 30 includes an upper portion 33 axially rising from the plate portion 31. Accordingly, the upper portion cylindrical wall 33 has an inner surface 33*a*, a top surface 33*b*, and an outer surface 33*c*. With this structure, the seal portion outer surface 151*b* contacts the inner surface 33*a*.

The annular collar 150 further includes an annular cup portion 153 having bottom and top surfaces 153*a* and 153*b*. The bottom surface 153*a* abuts the top surface 33*b* of the pattern plate cylindrical wall upper portion 33 and, in addition, wraps around the top surface 33*b* a small amount to contact a portion of the outer surface 33*c* of the pattern plate cylindrical wall upper portion 33. In this configuration, the grit member annular collar bottom surface 153*c* and the pattern plate cylindrical wall upper portion 33 cooperate to generally retard entry of foreign matter therebetween.

The grit member 14 further includes a resiliently deformable outer wall 155 rising from an outer portion of the cup portion 153. The outer wall 155 meets with the top surface 153*b* of the cup portion 153, which is generally flat so that the likelihood of matter being trapped or lodged against the cup portion 153 or within the grit member 14 is minimized.

When the sprinkler head 10 is shut off, the deflector 100 shifts downward and rests in contact with the outer wall 155 of the grit member 14. The outer wall 155 has an inner surface 155*a* that is angled outward and upward. When the deflector 100 shifts downward, such as when the water is shut off, the deflector 100 is received against the inner surface 155*a*, and the relatively soft outer wall 155 deflects outward. By doing so, the deflector bottom surface 102 is covered, and debris cannot come in contact therewith. When the sprinkler head 10 is activated, the deflector 100 shifts upward, and the deflector 100 thereby separates from the grit member 14 so that the grit member 14 does not frictionally engage the deflector 100, which otherwise would retard the spinning of the deflector 100 and cause life-reducing wear on the grit member 14. If particles do find entry between the deflector 100 and grit member 14 during operation, the debris is not likely to cause the deflector 100 to lock with the soft grit member 14, and the soft outer wall 155 may deform outwardly such that the force of the exiting water may force the foreign matter out of the sprinkler head 10.

As discussed above and depicted in FIG. 7, the axle 70 may be rotated to alter the relative positions of the valve members 50, 80 in order to regulate the flow of water through the sprinkler head 10. To do so, a top surface 71 is provided on the axle 70 including a receptor in the form of a groove 71*a* for receiving a tool (not shown) for rotating the axle 70 and, consequently, the movable valve member 80. The cap 110 includes a top surface 114 having a central recess 116 surrounding the cap bearing surface 113. The axle 70 projects through the cap 110 and into the recess 116 to provide access for the tool for rotating the axle 70 to cooperate with the groove 71*a*.

Figure 13:
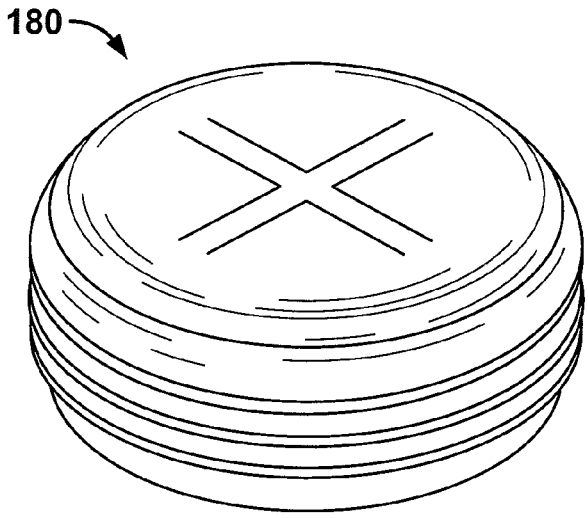
FIG. 13 is a perspective view of a plug of the sprinkler head.
Figure 14:
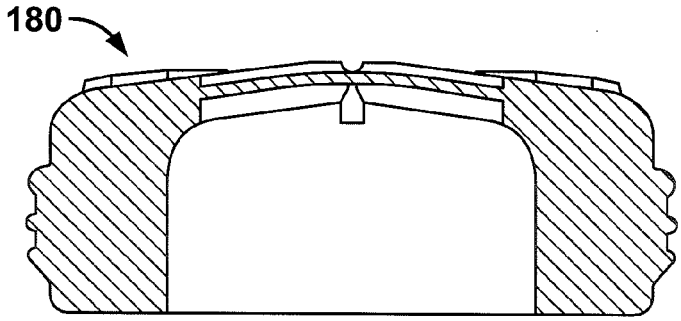
FIG. 14 is a cross-sectional view of the plug.

To prevent matter from entering the recess 116, and generally to protect the receptor groove 71*a*, a plug 180 is provided, best viewed in FIGS. 13 and 14. The plug 180 is a relatively stiff deformable member with a natural size slightly larger than the recess 116 so that the plug 180 is slightly compressed therein and forms a tight seal therewith. Alternatively, the plug 180 and recess 116 may have cooperating features or structure so that the plug 180 is compressed to fit within the recess 116, and then expands once in a proper position.

The plug 180 may be pierced or otherwise breached by the tool in order to rotate the axle 70. That is, the tool may create an opening by being forced through the plug 180, thus positioning the tool within the groove 71*a* for rotating the axle 70. The portions of the plug 180 adjacent the tool when the tool is inserted deform inwardly to allow the size of the tool to be located therebetween. When the tool is retracted or removed from the plug 180, the stiff plug 180 material returns to its natural position such that the opening made by the tool is generally closed tightly by the confronting portions of the opening made in the plug 180. Alternatively, the plug 180 may be formed with a pre-formed opening for allowing a tool to be inserted therethrough.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A sprinkler head for emitting water therefrom, the sprinkler head comprising:

an emission portion including openings for emission of water;

a deflector for directing the emission of water; and a resiliently deformable portion, wherein at least when the sprinkler head is emitting water from the openings, the resiliently deformable portion is positioned between at least a portion of the emission portion and at least a portion of the deflector to retard entry of foreign matter between the at least a portion of the emission portion and the at least a portion of the deflector.

2. The sprinkler head of claim 1 wherein the deformable portion includes an annular ring.

3. The sprinkler head of claim 2 wherein the annular ring includes an upstanding annular wall for retarding the entry of foreign matter.

4. The sprinkler head of claim 3 wherein the annular ring comprises a base portion for attachment to the emission portion.

5. The sprinkler head of claim 4 wherein the base portion coextends with the annular wall.

6. The sprinkler head of claim 4 further including a securement member for attaching the base portion to the emission portion.

7. The sprinkler head of claim 1 wherein the deformable portion includes a wall positioned on a top surface of the emission portion and extending towards the deflector.

8. The sprinkler head of claim 7 wherein the deformable portion wall may deform inward when force is applied to an outer surface thereof.

9. The sprinkler head of claim 7 wherein the deformable portion wall may deform outward when force is applied to an inner surface thereof.

10. The sprinkler head of claim 9 wherein the deformable portion wall is deformed outward when foreign matter is located between the deformable portion wall and the deflector.

11. The sprinkle head of claim 1 further including a spinning head portion, and the spinning head portion includes the deflector.

12. The sprinkler head of claim 11 wherein the deflector includes vanes located on a surface generally oriented in the downward direction for receiving water from the emission portion for emission from the sprinkler head, the deformable portion includes a wall positioned on a top surface of the emission portion and extending towards the vanes.

13. The sprinkler head of claim 12 wherein the deformable portion wall is deformed outward when foreign matter is located between the deformable portion wall and the deflector vanes.

14. A sprinkler head for emitting water therefrom, the sprinkler head comprising:

an emission portion including openings for emission of water;

a deflector for directing the emission of water;

a resiliently deformable portion, positioned at least when the sprinkler head is operative, the resiliently deformable portion is positioned between at least a portion of the emission portion and at least a portion of the deflector to retard entry of foreign matter between the at least a portion of the emission portion and the at least a portion of the deflector; and a spinning head portion, and the spinning head portion includes the deflector wherein the deflector includes vanes located on a surface generally oriented in the downward direction for receiving water from the emission portion for emission from the sprinkler head, the deformable portion includes a wall positioned on a top surface of the emission portion and extending towards the vanes and wherein the deformable portion wall is deformed outward when foreign matter is located between the deformable portion wall and the vanes and wherein the deformable portion wall is deformed by force exerted by the deflector forcing the foreign matter from between the deflector and another portion.

15. The sprinkler head of claim 14 further including:

a valve portion for regulating the flow of water through the sprinkler head;

a plug; and a shaft portion on which the spinning head portion and valve portion are rotatably mounted, the spinning head including a recess through which a top portion of the shaft extends, the shaft portion being selectively positionable for adjusting the valve portion by engaging the shaft top portion, the plug being positioned in the recess so as to cover the recess and shaft top portion located therein, and the plug being breachable for receiving a tool for engaging the shaft top portion.

16. A sprinkler head for emitting water outwardly therefrom in an arcuate pattern, the sprinkler head comprising:

a spinning head portion including a deflector;

a braking mechanism for controlling a rate of spin for the head portion;

an emission portion for directing water against the deflector for distribution therefrom; and a resiliently deformable portion positioned downstream of at least a portion of the emission portion at least when the sprinkler head is emitting water outwardly to retard entry of foreign matter into the sprinkler head.

17. The sprinkler head of claim 16 further including a shaft around which the spinning head portion, the braking mechanism, and the deformable portion are positioned.

18. The sprinkler head of claim 17 wherein the spinning head portion shifts upwardly when the deflector is contacted by a water flow from the emission portion.

19. A sprinkler head for emitting water outwardly therefrom in an arcuate pattern, the sprinkler head comprising:

a spinning head portion including a deflector;

a braking mechanism for controlling a rate of spin for the head portion;

an emission portion for directing water against the deflector for distribution therefrom;

a resiliently deformable portion positioned downstream of at least a portion of the emission portion at least when the sprinkler head is operative to retard entry of foreign matter into the sprinkler head; and a shaft around which the spinning head portion, the braking mechanism, and the deformable portion are positioned wherein the spinning head portion shifts upwardly when the deflector is contacted by a water flow from the emission portion and wherein the braking mechanism is engaged by the upward shifting of the spinning head portion.

20. The sprinkler head of claim 19 wherein the braking mechanism provides a brake force generated by confronting brake pads, and the brake force varies with the flow of water striking the deflector.

21. The sprinkler head of claim 18 wherein the spinning head portion is separated from the deformable portion by a distance when shifted upwardly by water striking the deflector.

22. The sprinkler head of claim 21 wherein at least a portion of the deflector is received by the deformable portion when the water flow through the sprinkler is turned off.

23. The sprinkler head of claim 16 wherein the deformable portion is formed of relatively resilient material.

24. The sprinkler head of claim 23 wherein the deformable portion includes a wall extending towards the deflector, and the wall may deform in a direction in which force is applied.

25. The sprinkler head of claim 24 wherein the deformable portion wall is deformed outward when foreign matter is located between the deformable portion wall and the deflector such that the foreign matter is forced out of the sprinkler head.

26. A sprinkler comprising:

a nozzle body configured for attachment to a supply of pressurized fluid and having at least one nozzle opening to discharge fluid;

a deflector mounted for rotation relative to the nozzle body and positioned to receive fluid from the at least one nozzle opening, fluid impacting on the deflector causing the deflector to rotate and redirect fluid outward from the sprinkler through at least one discharge port formed at least in part by the deflector and the nozzle body; and a resiliently deformable barrier at the at least one discharge port to permit fluid discharge from the at least one discharge port and retard entry of foreign matter into the at least one discharge port.

27. The sprinkler body of claim 26 wherein the resiliently deformable barrier comprises a base portion for attachment to the body and a wall portion extending across at least a portion of the at least one discharge port.

28. The sprinkler body of claim 27 wherein the at least one discharge port extends about the sprinkler, and the wall portion of the deformable barrier forms an annular collar coinciding with the at least one discharge port.

* * * * *